US005912681A

United States Patent [19]

Uetuki et al.

[11] Patent Number: 5,912,681

[45] **Date of Patent: *Jun. 15, 1999**

[54] CAPPING MECHANISM FOR INK JET RECORDER

[75] Inventors: Masaya Uetuki; Noribumi Koitabashi, both of Yokohama; Hitoshi Nishikori, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/545,087

[22] Filed: Oct. 19, 1995

[30] Foreign Application Priority Data

Oct. 24, 1994 [JP] Japan ..... 6-258338

[51] Int. Cl.[6] ..... B41J 2/165

[52] U.S. Cl. ..... 347/29; 347/30

[58] Field of Search ..... 347/29, 32, 30, 347/36

[56] References Cited

U.S. PATENT DOCUMENTS

| | | | |
|---|---|---|---|
| 4,045,802 | 8/1977 | Fukazawa et al. | 347/29 |
| 5,155,497 | 10/1992 | Martin et al. | 347/33 |
| 5,166,707 | 11/1992 | Watanabe et al. | 347/32 |
| 5,448,271 | 9/1995 | Yamaguchi et al. | 347/32 |
| 5,625,385 | 4/1997 | Suzuki | 347/24 |

FOREIGN PATENT DOCUMENTS

| | | | |
|---|---|---|---|
| 52-138132 | 11/1977 | Japan | B41J 3/00 |
| 404161343 | 6/1992 | Japan | B41J 2/165 |
| 5201009 | 8/1993 | Japan | B41J 2/165 |

*Primary Examiner*—Benjamin R. Fuller
*Assistant Examiner*—Thien Tran
*Attorney, Agent, or Firm*—Fitzpatrick, Cella, Harper & Scinto

[57] ABSTRACT

An ink jet recording apparatus includes a cap to cover the discharge ports for discharging ink. This cap includes an atmospheric conduction passage for conductively connecting the interior of the cap with the air outside, and an ink exhausting device for exhausting ink deposited in the interior of the cap to the outside preferably by utilizing the ink's own weight. With this cap structure, ink is exhausted outside the cap, thus reliably coping with ink leakage that might otherwise take place when ink tanks are replaced or the main body is vibrated. At the same time, it is made possible to maintain the atmospheric conduction passage in good condition at all times.

10 Claims, 7 Drawing Sheets

CAPPING MECHANISM FOR INK JET RECORDER

BACKGROUND OF THE INVENTION

1. Field of the Invention

The present invention relates to an ink jet recording apparatus and a capping mechanism used therefor. In this respect, the recording is meant to include the provision of ink (printing) or the like for all the ink carriers that may accept it, such as cloths, threads, papers, and sheet materials, and also, it includes not only meaningful images such as characters, but also, meaningless images such as patterning images. Here, the recording apparatus includes all the various information processing apparatus, and printers used therefor as the output equipment thereof. The present invention is applicable to the uses of these apparatuses and equipment.

2. Related Background Art

As the output equipment of a personal computer, copying machine, facsimile apparatus, or the like, there are used recording apparatuses of thermal transfer, LBP, dot impact, ink jet, or other types.

Of these recording apparatuses, the one using ink jet method is given much attention as a printing method superior in quietness in operation. Particularly, the one that utilizes the foaming of liquid by the application of heat provides excellent features in that it easily produces a higher density, operates in a quieter mode, easily meets with coloring requirements, and withstands a higher printing, among others that it is able to demonstrate. Therefore, the use of this apparatus is given much attention as a printing method that provides a higher quality at lower costs.

Also, along with a higher speed required for the operation, it has been generally practiced to use a recording head having a plurality of recording elements being arranged on it (hereinafter, referred to as a multiple head), and also, to use an apparatus provided with a plurality of such multiple heads, which is being developed to meet with increasing demands on recording in colors.

FIG. 6 is a perspective view which shows the principal part of a printer that records on the surface of a sheet by discharging ink from the multiple head substantially downward in the vertical direction. In FIG. 6, a reference numeral 30 designates ink cartridges. These are formed by ink tanks 29 containing ink of four colors, black (Bk), cyan (C), magenta (M), and yellow (Y), respectively, and a multiple head 29. Here, a reference numeral 23 designates a carriage that supports four ink cartridges 30 and enables them to travel and record at the same time. It is arranged that the carriage is on the standby in the home position at h in the location shown in FIG. 6 when recording is at rest or the recovery operation is conducted for the multiple head.

When an instruction is issued to start recording, the carriage 23, which is in the position h (home position) before the recording operation is started, records on the surface of a sheet only by the width D by use of n numbers of multiple nozzles on the multiple head 28 while traveling in the direction x. When data are recorded completely up to the edge portion of the surface of the sheet, the carriage returns to the home position and begins recording again in the direction x. In case of a reciprocal recording, it records while traveling in the direction -x. During the period between the completion of this first recording and the start of the second recording, the sheet is fed in the direction y only by the width D. In this way, the recording for an area only by the width of the multiple head D and the sheet feeding therefor are repeated per carriage scan, thus completing data recording on the surface of one sheet.

Also, in a recording apparatus of the kind, recovery is performed if any non-discharge takes place. Therefore, a suction cap 27, whose use is shared by each of the heads 28, is provided for the recovery operation that is individually executed for each of the heads 28. Also, a pump 27*a* is provided for exerting negative pressure in this cap 27. With such arrangement, it becomes possible to make the structure simpler and fabricate the system at lower costs than the one having caps and pumps in the same numbers as those of the heads.

Further, in a position between the cap 27 and a recording sheet carrier unit, a wiper blade 31 is provided for wiping and cleaning the leading end of the head 28.

The performance of a recording apparatus that records by discharging ink largely depends on the viscosity of ink to be used. In other words, depending on the viscosity of ink, the discharging amount, discharging speed, the upper limit of driving frequency, and various other characteristics of discharge greatly vary. Then, if the nozzles of an ink jet printer of the kind used for recording are left intact without discharging ink, the surface of nozzles dries to cause ink to be concentrated on the meniscus portion formed on the leading end of nozzles, thus raising the viscosity of ink. On the other hand, there is a limit for the degree of viscosity of ink that allows ink to be discharged in accordance with the energy that can be generated physically. If ink has become overly viscous and exceeds the viscosity limit due to such concentration, discharging is no longer possible. Therefore, non-discharge may ensue in some cases or even if non-discharge may be prevented, dots are twisted to easily invite the degraded quality of recorded images. In order to prevent the degradation of recorded images due to such non-discharge, twisting, or the like, discharges are periodically executed for the nozzles not in use or for the entire nozzles before the elapse of time estimated for encountering any resultant image degradation. In this way, a technique, the so-called "predischarge" that refreshes ink in the nozzle portion for the prevention of ink from becoming extremely over-viscous, is applied to many recording apparatuses. Nevertheless, although this technique is effective when recovering nozzles not in use while in carrying on recording or when recovering nozzles at rest for a short period of time, it should use an enormous amount of ink wastefully to implement the recovery of nozzles that are out of operation for a long period of time or left intact for a long time, because the recovery becomes extremely difficult in such cases. Therefore, this technique can hardly be defined as an appropriate means for the purpose.

Under such circumstances, if no discharge is conducted for a long time, a measure should be taken to prevent ink from being evaporated from the meniscus by covering the nozzle surface by use of some means. A technique of the kind is actually adopted for use by many recording apparatuses (for example, ink jet recording apparatuses manufactured by Canon Inc., Model Nos. BJ10V, BJC-600 and others). If a head protection means of the kind does not perform sufficiently, the over viscosity or drying advances extremely in the nozzles by the time elapses as described above, or additives, dyestuffs, or pigments in ink are educed. As a result, ink is solidified in the vicinity of nozzles, that is, the so-called fixation phenomenon is allowed to occur, there is a need for recovery operations by the application of suction, pressure, or the like as far as such fixation phenomenon is slight. Also, if the fixation phenomenon advances deep into the nozzles, ink supply paths, or other parts in the interior of head, and the fixation becomes extremely strong, no recovery is possible by means of suction, compression purge, or the like, thus causing the head itself to be made unusable in some cases, requiring the replacement thereof. However, since the structure of heads used for ink jet recording apparatuses is complicated, its fabrication is not easy. Therefore, it often costs high, and the replacement of heads leads to the significant increase of running costs. Also, from the viewpoint of reliability enhancement, it is extremely important to prevent ink from being dried in order to avoid its over viscosity and solidified fixation.

In this respect, as a method of preventing ink from becoming overly viscous due to its evaporation, there is disclosed a method of protecting the facing plane of the head by use of a cap in Japanese Patent Laid-Open Application No. 52-138132, for example. Also, as a recent example, a cap is disclosed in Japanese Patent Laid-Open Application No. 5-201009 for the protection of the facing plane.

Also, there has been proposed in recent years a method of exchanging tanks by arranging the structure of the head for discharging ink and the structure of the tank for retaining ink separately for the purpose of curtailing running costs. The apparatus referred to in conjunction with FIG. 6 adopts an ink tank exchanging method of the kind. FIGS. 7A and 7B illustrate the such tank and head in detail. For the recording apparatuses that use the head and tank shown in FIGS. 7A and 7B, a method called "on carriage tank" is adopted to mount a tank 30 on the carriage 23 (see FIG. 6) that holds the head in order to shorten the supply system as much as possible. In case of such tank exchanging method, the interior of the tank 30 is generally divided into a portion where ink 35 is filled as it is, and a portion where an absorbent 33 is filled with ink 35 being absorbed in it as shown in FIGS. 7A and 7B. With such structure, when the ink supply port 28*a* of the head 28 is in contact with the absorbent 33 under pressure, ink contained in the portion 33*a* of the absorbent 30, which is being compressed thereby, is squeezed out from the absorbent 30 as the compression is increased. Therefore, in the vicinity of the supply port 28*a*, there may temporarily exist the ink in a state where no negative pressure is exerted. As a result, the negative pressure, which should be exerted from behind the meniscus in the ordinary use, is absent temporarily in some cases. In the case represented in FIGS. 7A and 7B, the tank is positioned higher than the facing plane 28*b* of the head, and pressure exerted on the meniscus is positive. Consequently, if the meniscus is broken in this state due to the wetting of the head face, vibration, or the like, ink 35 contained in the head begins to flow out to stop up the conducting hole occasionally.

A numeral 30*a* denotes an atomosphere communicating hole for communicating the interior of the tank 30 with the atmosphere.

The cap to prevent drying is considered ideal if it can close perfectly when its purpose is only to prevent drying. However, for a cap of a type to airtightly close, the interior of the cap is pressurized when it is used for the head protection, thus allowing the meniscus to be broken. Hence a phenomenon is observed that air is carried into the head or the ink, which is filled in the head, is caused to return to the tank side due to the negative pressure from the tank. Because of this phenomenon, there is a need for supplying ink into the head by means of suction, compression, or the like when the next recording is performed. This invites the increased consumption of wasted ink that is not used for recording per se.

Also, to the contrary, if the cap is released for the execution of recording, the interior becomes negatively pressurized when the cap parts from the facing plane of head. Thus the meniscus is broken and ink in the nozzles is drawn out, leading to a trouble such as wetting of the facing plane of head. Further, if the temperature changes after capping, the air in the cap is caused to expand or contract, resulting in the changes of atmospheric pressure to cause the same trouble as in releasing the cap.

Here, for example, a case where pressure is exerted at the time of capping is given below.

With the dimension of cap (inner dimensions) being: 5 mm laterally, 10 mm longitudinally, and 1 mm high for the rib, the inner volume of the cap will be as follow, provided that the amount of deformation of the cap rib is 0.2 mm after closing the cap:

$$\textit{Volume at closing}\ 5\times10\times1.0=50\ mm^3$$

$$\textit{Volume after capping}\ 5\times10\times0.8=40\ mm^3$$

The atmospheric pressure in the cap changes as shown in the following expression:

$$P_1V_1/T_1=P_2V_2/T_2$$

$$1.50/T=P_2.40/T$$

$$P_2=50/40=1.25\ (atm) \qquad (2)$$

At the time of capping with the structure described above, the interior of the cap is in a state that pressure is exerted at 0.25 atm as compared to the atmospheric pressure.

Also, when pressure is exerted due to the change of temperatures after capping, the atmospheric pressure in the cap changes as the expression given below, provided that the capping is conducted at an outer temperature of 5° C., and then, the temperature rises to 35° C.

$$P_1V_1/T_1=P_2V_2/T_2$$

$$1.V/278=P_2.V/308$$

$$P_2=308/278=1.11\ (atm) \qquad (2)$$

When the temperature changes as described above, the interior of the cap is in a state that pressure is exerted at 0.11 atm as compared to the atmospheric pressure. Therefore, when closing the cap with such change of temperatures, it is anticipated that the meniscus is broken to cause defective discharges to occur.

In order to avoid the obstacles as described above, a mechanism called an atmospheric conduction hole is arranged for the cap to enable its interior to lead conductively to the air outside, thus avoiding changes of pressure.

For example, an embodiment is disclosed in Japanese Patent Laid-Open Application No. 5-201009, wherein a cap is formed by adhesively bonding two members, while providing an atmospheric conduction hole on the face thus formed by bonding. In other words, as shown in FIGS. 8A and 8B, a cap is structured by a capping rubber 2 and a cap holder 3, and then, a groove is formed on the bottom face of the cap holder 3. In this way, the gap between this groove and a closing member 40 to close the aperture is provided for the atmospheric conduction hole 1. For the purpose of preventing ink from being dried, the diameter of the atmospheric conduction hole 1 should preferably be as small as possible, and its length should preferably as long as possible.

Nevertheless, when ink leakage takes place as described earlier, ink resides in the interior of the cap to clog the atmospheric conduction hole, hence causing ink to drop off in some cases.

Also, there is naturally a limit to receiving and retaining ink by the application of a mode such as proposed in Japanese Patent Laid-Open Application No. 5-201009, in which an atmospheric conduction hole is formed on the face where two members are adhesively bonded, and then, an arrangement is made to utilize the gap between two members formed on both sides of the atmospheric conduction, and to absorb ink by means of capillary force created by use of such gap. Also, since the portion to receive ink is the gap between the two members, the gap should be formed to provide a large capacity inevitably if it is intended to increase the volume of in to be received. In this case, the effectiveness to prevent ink from being dried should be reduced accordingly. On the other hand, it becomes difficult to provide a sufficient volume on the circumference of the atmospheric conduction hole to receive and contain ink if it is intended to sufficiently enhance the effectiveness to prevent ink from being dried. Furthermore, in accordance with this method, leaking ink passes the conduction hole, and conceivably, a small amount of ink resides on the aperture on the head side of the conduction hole, the aperture on the outside air side, and some other parts, respectively. Therefore, this arrangement can hardly be an ideal one as a method of preventing the conduction hole from being clogged.

Also, disclosed in Japanese Patent Laid-Open Application No. 5-201009 as another structure, there is provided a cut off portion formed on its facing plane as a conduction hole, but this cut off portion can hardly be regarded as a desirable mode, because it is difficult to make such hole sufficiently long and thin for the prevention of ink from being dried. There is also a fear that the conduction hole thus formed is clogged by ink adhering to the facing plane. Here, this hole is used together with a mechanism in which a buffer is provided to prevent pressure from changing, and the interior of the cap that covers the facing plane and the buffer is conductively connected by a movable thin film. Under such structure, it is arranged to receive leaking ink by means of the cap. With this arrangement, it is impossible to receive and retain ink in an amount more than the inner volume of the cap. Consequently, if it is intended to secure a sufficient volume for the anticipated ink leakage, there is a need for increasing the inner volume of the cap, while it is required to minimize the volume that may bring about more evaporation from the interior of the cap. Therefore, the cap should be prepared to effectuate two different performances that contradict to each other.

In accordance with such conventional art, the tolerance is extremely low with respect to the anticipated ink leakage. There is a fear, therefore, that any one of these methods cannot cope with the ink leakage that occurs when using the method for exchanging head units of the conventional type where the ink tank and head are integrally formed, and that it is more difficult to cope with the ink leakage that occurs when using the recent tank exchanging method described earlier.

SUMMARY OF THE INVENTION

In consideration of these situations, the present invention is designed. It is an object of the invention to provide a capping mechanism capable of preventing the clogging of the atmospheric conduction hole of a cap arranged for the prevention of ink from being dried in the nozzles that discharge ink, and to provide an ink jet recording apparatus that uses such capping mechanism.

For the achievement of this object, one aspect of the present invention is the provision of an ink jet recording apparatus provided with a cap to cover the discharge ports for discharging ink. This cap comprises an atmospheric conduction hole that conductively connects the interior of the cap with the air outside, and ink exhausting means for exhausting ink to the outside of the cap by utilizing the own weight of ink being deposited in the cap.

Another aspect of the present invention therefor is a capping mechanism provided with a cap to cover the discharge ports for discharging ink. This cap comprises an atmospheric conduction hole that conductively connects the interior of the cap with the air outside, and ink exhausting means for exhausting ink to the outside of the cap by utilizing the own weight of ink being deposited in the cap.

By means of such mechanism for exhausting ink to the outside, it is possible to reliably cope with the ink leakage that may be caused by the replacement of tanks or by the vibration of the main body, and maintain the atmospheric conduction hole in good condition at all times.

DETAILED DESCRIPTION OF THE PREFERRED EMBODIMENTS

For the present invention, there are arranged for a cap to cover ink discharge ports, an atmospheric conduction passage that conductively connects the interior of the cap with the air outside, and also, ink exhausting means for exhausting ink to the outside by utilizing the own weight of ink being deposited in the cap. With these elements, it is possible to reliably cope with ink deposited in the cap, and maintain the atmospheric conduction passage in a good conductive condition at all times simultaneously.

In accordance with the present invention, it is preferable for an apparatus of the type, in which the cap performs its capping substantially upwardly in the vertical direction with respect to the discharge ports for discharging ink substantially downwardly, to arrange at least the bottom plate of the cap to be in a mode that as ink exhausting means, this plate is able to part from or abut upon the other parts. In this way, it is possible to exhaust ink smoothly by utilizing its own weight, and also, to reliably prevent ink from being solidified and fixed by allowing a comparatively large member such as the bottom board of the cap to move away from or abut upon the other part.

It is further preferable to use the gap between the capping unit that contacts the discharge port surface and the cap holder that holds the capping unit as the ink exhausting passage, and then, to arrange the ink let-out unit, which conducts ink from the discharge ports to the ink exhausting passage, to be in the mode that it is able to cover the aperture of the cap. In this way, ink is exhausted more smoothly by means of capillary force and the variation of space of the gap that serves as the ink exhausting passage, in addition to the application of its own weight.

It is still more preferable to arrange the aperture of the atmospheric conduction passage of the cap to be in the mode that it is positioned below the ink let-out unit and away from the inner wall of the cap. In this way, ink is not easily allowed to drop off from the discharge ports and enter the atmospheric conduction passage.

In this respect, the volume of the receptacle to receive ink in the cap should preferably be larger than that of the retainer of ink of the ink jet head. Also, the volume of the receptacle in the cap should preferably be larger than the cubic content of ink supply port of the ink jet head that enters the ink tank. In the usual condition of use, the maximum amount of ink that may drop off from the ink jet head is equal to the voluminal portion of the ink retainer of the ink jet head or the cubic content of the ink supply port that enters the ink tank, but this arrangement is made to prevent the overflowing of ink from the aperture of the cap on the head side as much as possible even if the maximum amount of ink should be allowed to drop off.

Figure 6:
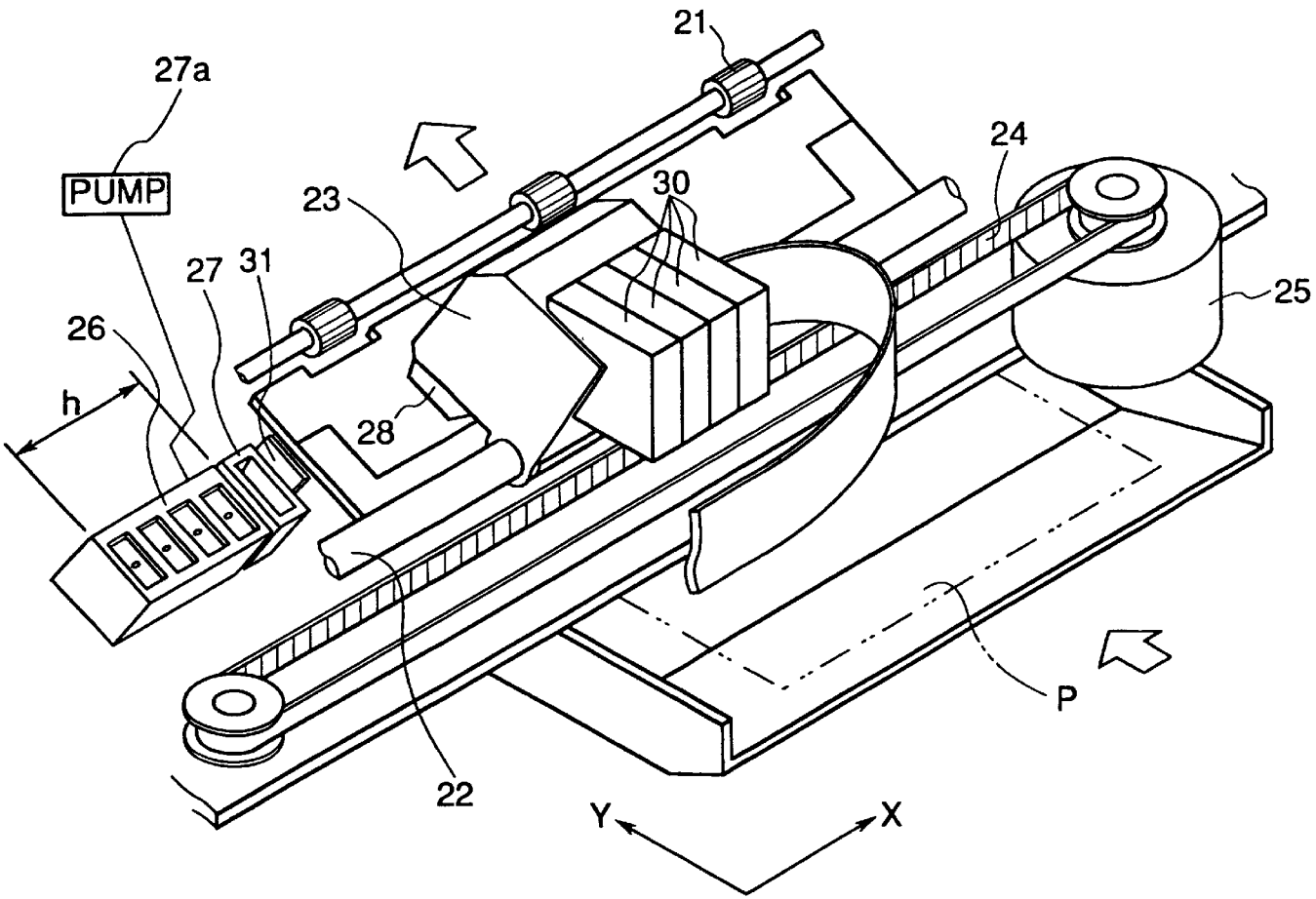
FIG.6 PRIOR ART
FIG. 6 is a view which shows one example of the external appearance of an ink jet recording apparatus.
Figure 7A:
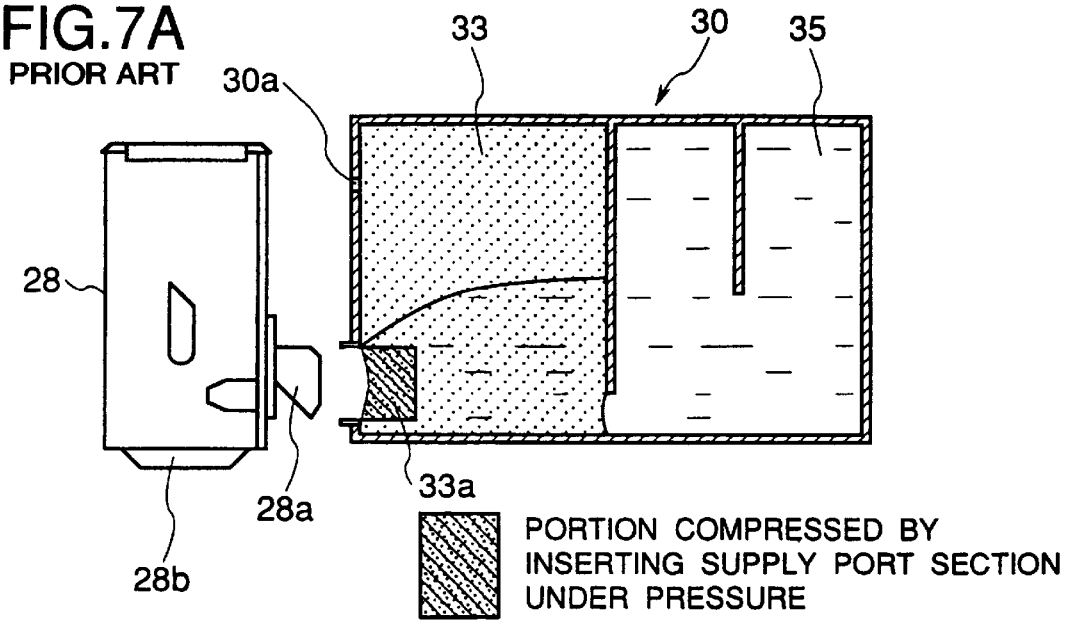
FIG.7A PRIOR ART
FIGS. 7A and 7B are views which schematically shows one example of an ink jet head.
Figure 7B:
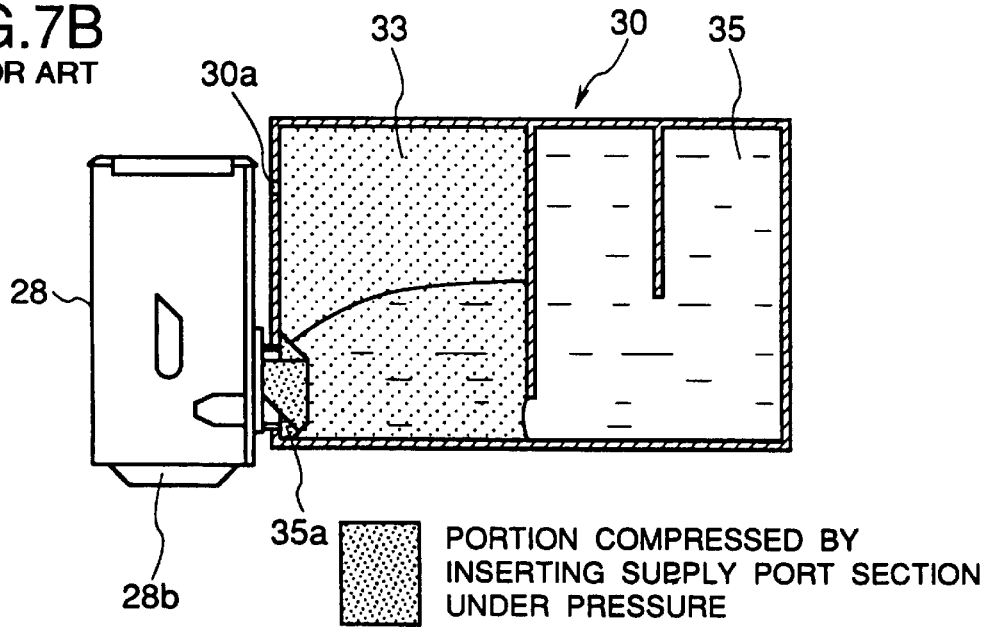
FIG.7B PRIOR ART
Figure 8A:
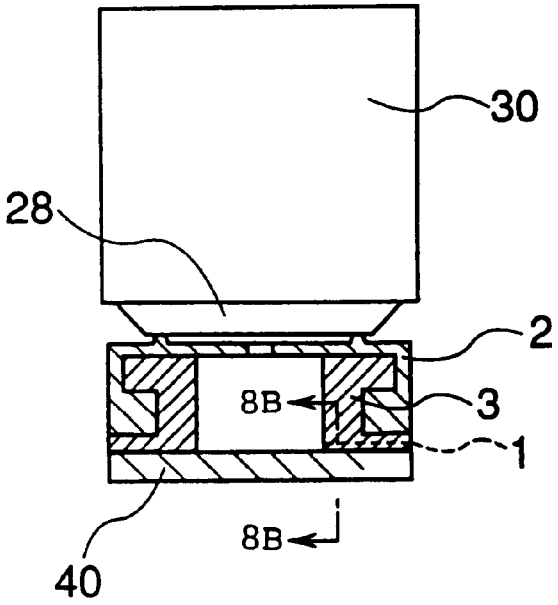
FIG.8A PRIOR ART
FIG. 8A is a cross-sectional view which shows a capping mechanism and head in accordance with the prior art.
Figure 8B:
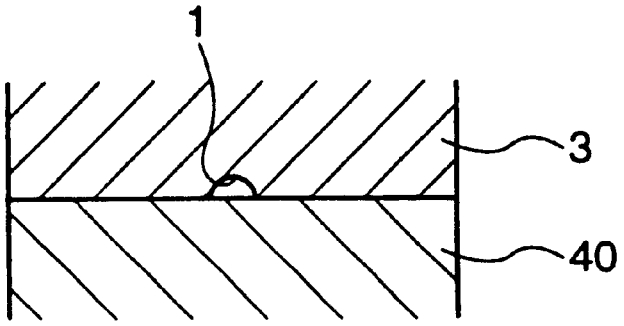
FIG.8B PRIOR ART
FIG. 8B is a cross-sectional view taken along line 8B—8B in FIG. 8A.

Hereinafter, in accordance the embodiments, the present invention will be described in detail. In this respect, while the description will be made centering on the capping mechanism, it is to be understood that various structures may be adoptable for the ink jet recording apparatuses, which are capable of being provided with a capping mechanism of the kind, such as illustrated in FIG. 6, FIG. 7A, and FIG. 7B, among others.

(Embodiment 1)

Figure 1A:
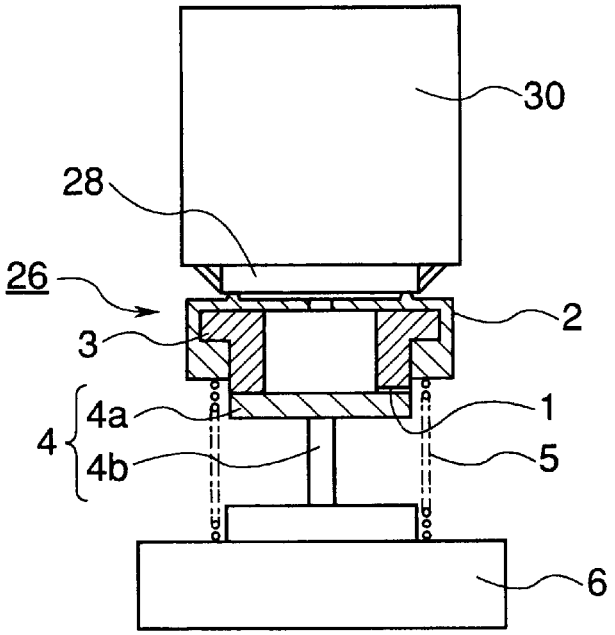
FIGS. 1A and 1B are cross-sectional views which illustrate a cap and a head in accordance with the embodiment 1 of the present invention.
Figure 1B:
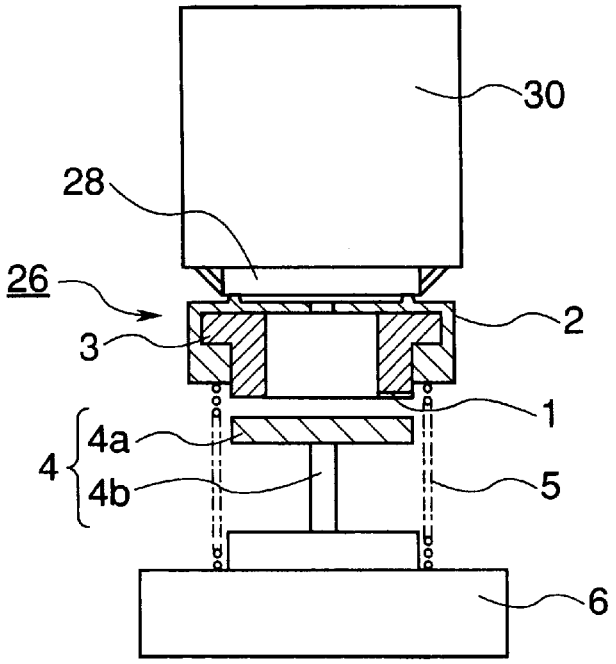

FIG. 1A and 1B are views which conceptually illustrate a head and a capping mechanism in accordance with a first embodiment of the present invention. As shown in FIGS. 1A and 1B, a structure is arranged for the present embodiment to release ink in the cap when a closing plate provided on the bottom end of the cap is caused to part from the cap holder as the cap is released.

FIG. 1A is a cross-sectional view which shows the head 28 and capping mechanism 26 in a state that the head is protected by capping. The cap comprises a capping rubber 2 to be closely in contact with the facing plane 28*b* of the head 28, and a cap holder 3 to support the capping rubber 2 while being embraced by the capping rubber 2, and then, the cap is formed integrally by them. The bottom of the cap holder 3 is open, and an atmospheric conduction hole 1 is formed on this bottom. The capping rubber 2 and cap holder 3 are movably supported by a pressure plate 6 through a spring 5 in the vertical direction in FIGS. 1A and lB, and a closing member 4 is supported on the inner side of the spring 5 between the pressure plate 6 and the cap holder 3. The closing member 4 comprises a plate 4*a* that closely contacts with the bottom end of the cap holder 3, and a supporting member 4*b* that fixes the closely contacting plate 4*a* and the pressure plate 6.

With such a capping mechanism as this, the capping rubber 2 is closely in contact with the head 28 by the application of compressing force of the spring 5 when the pressure plate 6 is raised at the time of capping as shown in FIG. 1A, and then, the plate 4*a* is caused to be closely in contact with the bottom end of the cap holder 3. In this way, the capping is perfectly executed to desirably prevent nozzles from being dried.

On the other hand, when the cap is released for recording, the closely contacting plate 4*a* fixed to the pressure plate 6 is caused to part from the bottom of the cap holder 3, thus being in a state shown in FIG. 1B at first. If ink resides in the cap 26 at this stage, it is exhausted from the bottom aperture of the cap holder 3. Then, the pressure plate 6 moves downward, and when the spring 5 is caused to expand to the maximum, the capping rubber 2 and the cap holder 3, which are pressed to the facing plane by means of the spring 5, part from the ink discharge surface of the head 28, thus making recording and other operations ready.

With the embodiment described above, the atmospheric conduction hole 1 is formed by the gap by use of the closely contacting plate 4*a* and a cut off portion of the bottom end of the cap holder 3 so that its fabrication is made easier, but it may be possible to provide the atmospheric conduction hole 1 by making holes on the cap holder 3, capping rubber 2, and closely contacting plate 4*a* individually or by providing a cut off portion or the like on the part where these constituents are in contact with each other so as to enable it to serve as an atmospheric conduction hole.

Figure 2A:
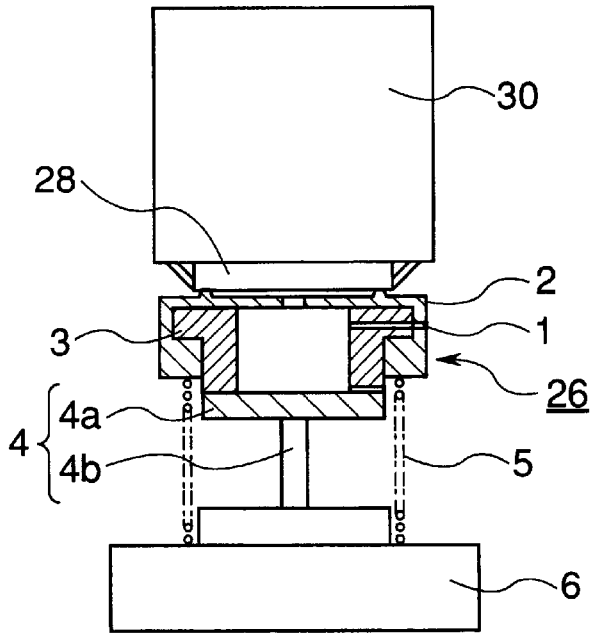
FIGS. 2A and 2B are cross-sectional views which illustrate another example of the cap and head in accordance with the embodiment 1 of the present invention.
Figure 2B:
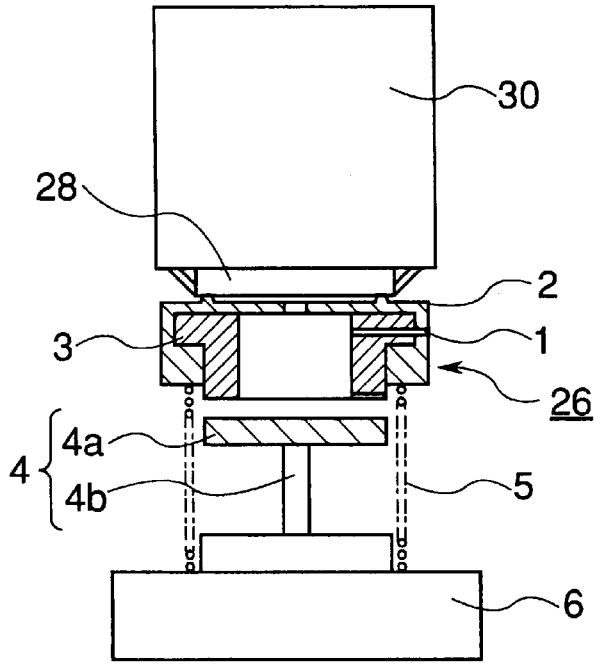

FIGS. 2A and 2B are the same as FIGS. 1A and 1B with the exception of the holes on the side walls of the cap holder 3 and the capping rubber 2, which are made to serve as an atmospheric conduction hole 1. While applying the same reference numerals to the same members appearing on Figs. 1A and 1B, any repeated descriptions will be omitted. With such a structure as this, the atmospheric conduction hole 1 is formed above the side wall of the cap holder 3, and then, the volume of the ink receptacle portion arranged by the cap holder 3 and the closely contacting plate 4*a* is made more than the estimated amount of ink leakage that may be caused when replacing tanks or the like. Hence it is arranged that the amount of ink leakage that may take place at one time does not fill in the receptacle up to the atmospheric conduction hole 1.

The cap shown in FIGS. 2A and 2B is incorporated in a recording apparatus, and ink is intentionally caused to drop off in the cap so that the same phenomenon as ink leakage is created. Here, (1) ink is caused to drop off, (2) the apparatus is left intact at high temperatures under low humidities, and (3) defects are confirmed by recording, and then, these steps are repeated. The example thus obtained is shown in Table 1. As a comparative example, the apparatus is used with the closely contacting plate 4*a* being fixed to the bottom end of the cap holder 3 shown in FIG. 2A. The amount of ink to drop off is set for a volume that can be removed by the close contact between the head and tank. Also, in order to check the defective recording, a pattern is arranged for recorded to make it possible to confirm the discharging condition of each nozzle. After having confirmed the discharge per nozzle, the discharges by use of all the nozzles are executed for a portion of several scans. In this way, confirmation is made as to the presence and absence of inking off due to the air bubbles squeezed into the head when the conduction hole is clogged. In this respect, the exhausting operation is performed before recording at each time of releasing cap by use of this structure.

The results are as shown in Table 1. Whereas the clogging occurs only by the ink leakage of approximately three times when no system is provided for exhausting the ink that has leaked, there are observed no defects resulting from any clogging even by ink leakage of 20 times when applying the present embodiment where ink exhausting means is provided.

TABLE 1

| Defective recording due to cap configuration and ink leakage | | |
|---|---|---|
| Numbers of ink leakage | Defective recording | |
| | Embodiment | Comparative example |
| First | No defect | No defect |
| Second | No defect | No defect |
| Third | No defect | No defect |
| Fourth | No defect | Inking off observed |
| Fifth | No defect | Inking off observed |
| Sixth | No defect | |
| . | No defect | |
| . | No defect | |
| . | No defect | |
| 20th | No defect | |

(Embodiment 2)

Figure 3:
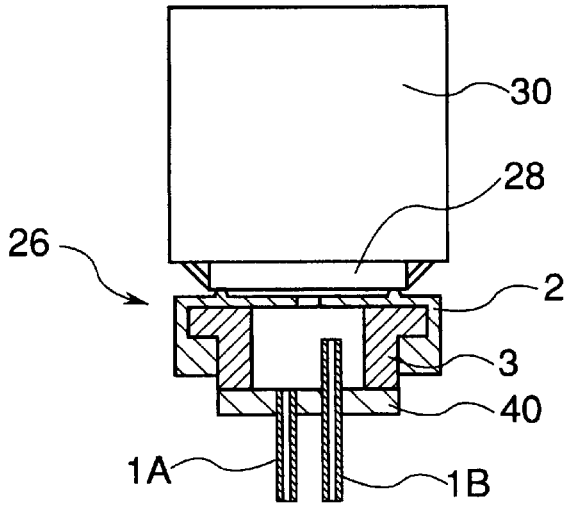
FIG. 3 is a cross-sectional view which shows another example of the cap and head in accordance with the embodiment 2 of the present invention.
Figure 4:
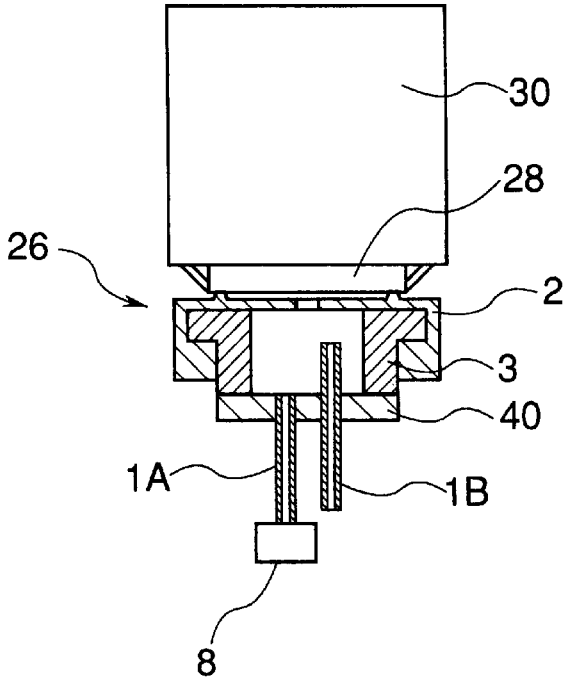
FIG. 4 is a cross-sectional view which shows another example of the capping mechanism in accordance with the embodiment 2 of the present invention.

FIG. 3 is a view which shows a capping mechanism in accordance with a second embodiment of the present invention. In this respect, the same reference numerals are applied to the same members appearing in FIGS. 1A and 1B, and FIGS. 2A and 2B, and any repeated description thereof will be omitted.

The cap 26 of the present embodiment comprises a capping rubber 2 and a cap holder 3. A closely contacting member 40 is fixed to the bottom end of the cap holder 3. On the closely contacting member 40, tubular members, each serving as a conducting hole 1A and a conducting hole 1B are penetratingly held, respectively, to function as atmospheric conduction holes. The upper end of the conducting hole 1A is made flush with the surface of the closely contacting member 40. On the other hand, the upper end of the conducting hole 1B is made away from the closely contacting member, and positioned above it. Therefore, it is possible to exhaust the ink deposited in the conducting hole 1A. In this case, the conducting hole 1B is used as a hole to supply air when exhausting ink.

With the structure described above, the ink deposited in the cap is sucked into the atmospheric conduction hole 1A by means of capillary force, and exhausted by its own weight from the aperture on the outside air side. As a result, even if the atmospheric conduction hole 1A is temporarily clogged by ink, the overly viscous ink that has been solidified and fixed is dissolved again when the next ink leakage takes place. Hence, it is anticipated that the effect of the exhausting performance is not easily marred.

Also, in order to maintain the performance of absorption sufficiently and prevent ink from residing in the atmospheric conduction hole, it may be possible to arrange an absorbent 8, which is provided with a pore diameter smaller than the hole diameter of the atmospheric conduction hole, and to pass it to the aperture of the atmospheric conduction hole 1A on the outside air side. In the case of this structure, the ink that enters the conduction hole 1A is carried to the leading end of the conduction hole on the absorbent side by means of the capillary force and its own weight as in the example described above. Here, it is possible to easily exhaust ink from the atmospheric conduction hole 1A if only the capillary force of the absorbent 8 is made greater than the capillary force of the atmospheric conduction hole 1A by adjusting the contact angles, pore diameters of absorbent, or the like appropriately.

(Embodiment 3)

FIGS. 5A to 5E are views which illustrate a capping mechanism in accordance with a third embodiment of the present invention. The present embodiment is such that the gap between a capping rubber 102 and a cap holder 103, which constitute a cap, is made an ink exhausting passage 101 (the gap being 0.03 to 0.08 mm, for example), and that an ink conductor unit 102*a,* which is formed integrally with the capping rubber 102, is arranged on the central part of the upper aperture of the capping rubber 102 in a mode that it extrudes therefrom, hence leaking ink being conducted to the exhausting passage 101. Also, the cap holder 103 is formed integrally with its bottom member. Through the bottom thereof, a tubular atmospheric conduction hole 1C is fixed penetratingly, and it is arranged to position the upper end of the atmospheric conduction hole 1C away from and above the bottom of the cap holder 103.

Figure 5A:
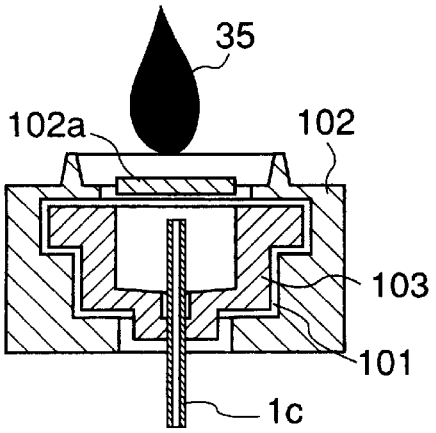
FIGS. 5A to 5E are cross-sectional views which illustrate the capping mechanism in accordance with the embodiment 3 of the present invention.
Figure 5B:
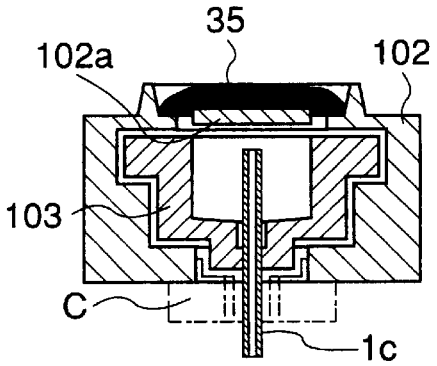
Figure 5C:
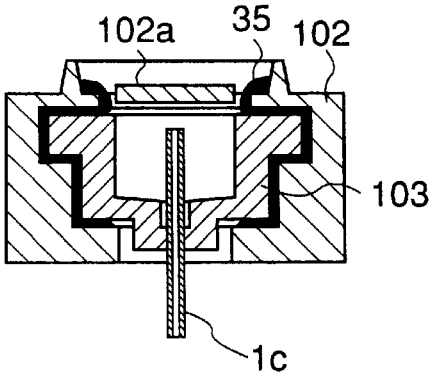
Figure 5D:
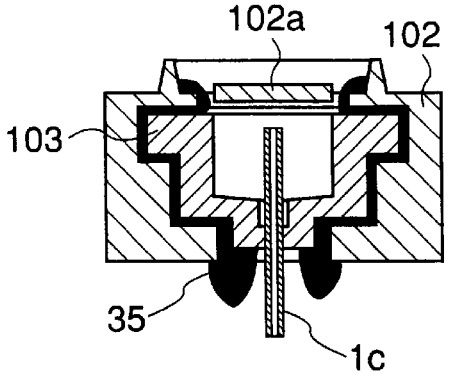
Figure 5E:
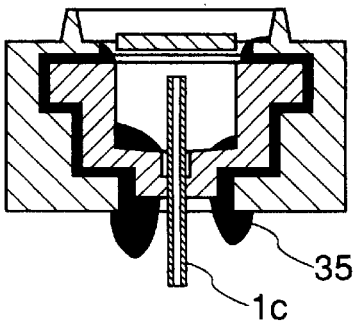

With the structure described above, leaking ink 35 is caused to flow forcibly in the direction toward the exhausting passage 101 by the ink conductor unit 102*a* before it reaches the atmospheric conduction hole 1C (see FIGS. 5A and 5B), and then, absorbed and exhausted into the exhausting passage 101 by means of its capillary force (see FIGS. 5C and 5D). Also, the ink 35 thus absorbed is exhausted to the outside by the variation of the gap between the cap holder 103 and the capping rubber 102, which is created by the deformation of the capping rubber 102 along with the capping operation, as well as by means of gravity resulting from its own weight (see FIG. 5D). The ink 35 that has arrived at the lower end (at C in FIG. 5B) of the holder shown in FIG. 5D and resides in that portion is caused to drop off by its own weight by the capping operation performed by use of the main body. In this respect, if an absorbent is installed at C in FIG. 5B, it is possible to obtain a higher exhausting effect.

The difference between the present embodiment and the one disclosed in Japanese Patent Laid-Open Application No. 5-201009 is that the structure hereof makes it possible to absorb ink forcibly into the exhausting passage 101 through the ink conductor unit 102*a* without allowing the ink to reach the atmospheric conduction hole.

Furthermore, in the case of the present embodiment, there is provided a portion to retain ink before the ink reaches the upper aperture of the atmospheric conduction hole 1C. Therefore, even if an imperfect ink exhausting should be executed or any ink exhausting is not executed, there is no possibility that the cap is clogged by the fixation of ink (see FIG. 5E).

As described above, with the provision of such ink exhausting mechanism, it is possible to prevent the atmospheric conduction hole from being clogged, and obtain an enhanced reliability without increasing ink consumption.

What is claimed is:

1. An ink jet recording apparatus, including an ink jet head having a discharge port for discharging ink and a cap to cover a surface of the ink jet head which includes the discharge port, said cap comprising:

a capping unit to contact the discharge port;

a cap holder to hold said capping unit;

an atmospheric conduction passage for conductively connecting an interior of said cap with outside air; and ink exhausting means including an ink exhausting passage formed by a gap between said capping unit and said cap holder, said ink exhausting means for exhausting ink deposited in the interior of said cap by utilizing weight of the deposited ink.

2. An ink jet recording apparatus according to claim 1, wherein said apparatus is provided with electrothermal transducing elements for generating thermal energy to create film boiling in said ink as energy generating elements for generating energy for discharging ink from said discharge port.

3. An ink jet recording apparatus according to claim 1, wherein besides said cap, an additional cap is provided for use of suction from said discharge port.

4. An ink jet recording apparatus according to claim 1, wherein said exhausting means is provided with an ink conductor unit for conducting leaking ink from said discharge port to said gap.

5. An ink jet recording apparatus according to claim 1, further comprising:

an ink tank configured for attachment to and detachment from said ink jet head for retaining ink supplied to said ink jet head.

6. An ink jet recording apparatus according to claim 5, wherein volume of a receptacle in said cap to receive ink is more than volume of retaining portion to retain ink in said ink jet head.

7. An ink jet recording apparatus according to claim 5, wherein volume of the receptacle in said cap to receive ink is more than volume of an ink supply port of said ink jet head entering said ink tank.

8. A capping mechanism having a cap to cover a surface of an ink jet head which includes discharge ports for discharging ink, said cap comprising:

a capping unit to contact the discharge ports;

a cap holder to hold said capping unit;

an atmospheric conduction passage for conductively connecting an interior of said cap with outside air; and ink exhausting means including an ink exhausting passage formed by a gap between said capping unit and said cap holder, said ink exhausting means for exhausting ink deposited in said cap by utilizing weight of the deposited ink.

9. An ink jet recording apparatus, including an ink jet head having a discharge port for discharging ink and a cap to cover a surface of the ink jet head which includes the discharge port, said cap comprising:

a capping unit to contact the discharge port;

a cap holder to hold said capping unit; and ink exhausting means including an ink exhausting passage formed by a gap between said capping unit and said cap holder, said ink exhausting means for exhausting ink deposited in an interior of said cap by utilizing weight of the deposited ink.

10. A capping mechanism having a cap to cover a surface of an ink jet head which includes discharge ports for discharging ink, said cap comprising:

a capping unit to contact the discharge ports;

a cap holder to hold said capping unit; and ink exhausting means including an ink exhausting passage formed by a gap between said capping unit and said cap holder, said ink exhausting means for exhausting ink deposited in said cap by utilizing weight of the deposited ink.

* * * * *

UNITED STATES PATENT AND TRADEMARK OFFICE

CERTIFICATE OF CORRECTION

PATENT NO. : 5,912,681

DATED : June 15, 1999

INVENTORS : MASAYA UETUKI et al.

It is certified that error appears in the above-identified patent and that said Letters Patent is hereby corrected as shown below:

On the title page, item [56]:

References Cited

FOREIGN PATENT DOCUMENTS

| | | |
|---|---|---|
| "404161343 | 6/1992 | Japan" should read |
| --4-161343 | 6/1992 | Japan-- and |
| "5201009 | 8/1993 | Japan" should read |
| --5-201009 | 8/1993 | Japan--. |

COLUMN 4

Line 29, "$P_2$=50/40=1.25(*atm*) (2)" should read
--$P_2$=50/40=1.25(*atm*) (1)--.

Signed and Sealed this

Twenty-fifth Day of January, 2000

*Attest:*

*Attesting Officer*

*Acting Commissioner of Patents and Trademarks*